United States Patent [19]

Riback et al.

[11] Patent Number: 4,942,274

[45] Date of Patent: Jul. 17, 1990

[54] BALL CONTROLLED FLOAT CONTROL UNIT

[75] Inventors: Richard Riback, Deerfield; Eric Will, Chicago, both of Ill.

[73] Assignee: Expert Corporation, Chicago, Ill.

[21] Appl. No.: 209,558

[22] Filed: Jun. 21, 1988 (Under 37 CFR 1.47)

[51] Int. Cl.[5] ..... H01H 35/18

[52] U.S. Cl. ..... 200/84 C; 73/313; 200/61.52

[58] Field of Search ..... 417/40; 307/118; 340/623, 625; 73/308, 313, 317; 200/DIG. 29, 553, 84 R, 84 C, 61.52; 335/205

[56] References Cited

U.S. PATENT DOCUMENTS

| | | | |
|---|---|---|---|
| 3,944,770 | 3/1976 | Pepper | 200/84 R |
| 4,021,145 | 5/1977 | Pepper | 417/40 |
| 4,064,755 | 12/1977 | Bongort | 200/84 C |
| 4,540,891 | 9/1985 | Keener | 200/84 R |
| 4,618,746 | 10/1986 | Schwob | 200/61.52 |
| 4,629,841 | 12/1986 | Riback | 200/553 |
| 4,644,117 | 2/1987 | Grimes | 200/84 R |
| 4,737,759 | 4/1988 | Stropkay | 200/61.52 |

*Primary Examiner*—Gerald P. Tolin

*Attorney, Agent, or Firm*—Howard B. Rockman

[57] ABSTRACT

An improved ball controlled float control unit wherein a slotted raceway housing pivotally accomodates a narrow ball cage within the slot and with the ball cage being in constant contact with said ball while the ball is permitted to be rollingly supported by the edges defining the slot, with the ball being precluded from getting out of or behind the ball cage, thereby eliminating any possibility of the ball locking up the control function of the unit.

13 Claims, 4 Drawing Sheets

BALL CONTROLLED FLOAT CONTROL UNIT

FIELD OF THE INVENTION

This invention relates to attitude responsive switches. More particularly, the invention relates to an improved ball-raceway float control unit which may include a ball and a ballcage to control an electrical circuit in response to changes in the attitude of the float control unit.

BACKGROUND OF THE INVENTION

Ball raceway float control devices typically include an enclosed tubular raceway and a ball which travels through the raceway to actuate a switch associated with the raceway. Ball raceway and switch assemblies can therefore respond to changes in attitude to control electrical circuits in power devices.

Ball raceway switch devices may be employed as a component of a sealed float control unit to control various means such as sump pumps, valves, etc. The float control unit may change attitude as the level of liquid varies, such as in sump where the level of water varies between a first lower level and a second higher level which is sufficient to activate a sump pump. When the water level is low, the ball raceway and switch assembly is typically disposed in a downwardly facing position such that the ball is positioned in an outside first end of the raceway. As the water level rises, the control unit floats to a higher attitude and the ball rolls to the opposite second end of the raceway to close a switch to actuate the pump. As the pump evacuates the water, the float returns to the original downwardly sloping attitude and the ball returns to the outside first end of the raceway to open the switch and shut off the motor. (Such motors being capable of activating various means, i.e., pumps, valves, etc.) Examples of various types of devices are disclosed in U.S. Pat. Nos. 3,944,770; 4,021,145; and 4,629,841.

The latter example, namely, U.S. Pat. No. 4,629,841, issued to Riback et al, assigned to the common assignee of the present invention, is an attitude controlled float switch which includes a ball cage for actuating a mechanical switch. The ball cage is free to pivot between either of two operative positions in response to a ball rolling from one end of the raceway, through the cage, and then to the other end of the raceway. The ball cage is retained in one of two operative positions by an over center spring. An alleged safety arm is provided to prevent the cage from inadvertently changing to another position so as to prevent entrapment of the ball between the cage an end of the raceway. The ballcage employed in Riback '841 attempted to enable the ball and ballcage to retain synchronism to operate a miniature switch in response to changes in attitude of the ball raceway float switch.

However, a difficulty surfaced in the use of the Riback device, namely, the ballcage may undesirably change position without movement of the ball therethrough as a result of vibrations, or inversion of the shipping container, such as may be incurred during shipment. This change in position of the ball cage can cause the ball to become entrapped between the ball cage and an end portion of the raceway with the result that the float switch may not be able to function properly, i.e., the switch may not be activatable, whereby the motor will not start, or, alternatively the motor may run continuously and be subject to burnout.

Similarly, mechanical switches employed in devices such as the Riback device set forth above, although generally reliable, tend to be subject to wear, fatigue, and potential malfunction. Alternative forms might be desirable.

SUMMARY OF INVENTION

An object of the present invention is to provide an attitude controlled, float control unit including a ball raceway which is resistant to undesired changes in mode of operation.

In particular, an object is to provide an improved ball cage for use in ball raceway switches to prevent the ball from becoming lodged between the ball cage and an end portion of the raceway.

The float control unit of the present invention is preferrably hermetically sealed and includes a symmetrical raceway, which raceway may have a cap at one end and is disposed within an elongated cylindrical sealed housing. The raceway, extending substantially between the distal and proximal ends of the housing, is adapted to receive a ball having a predetermined diameter and weight which freely traverses the length of the raceway. The raceway is retained in a fixed position relative to the housing and includes a central reduced confituration portion with a flared frusto-conically shaped member provided at each of the distal and proximate ends of the raceway and terminating in a generally cylindrical terminal portions which guide and enable the ball to readily communicate with the central portion and one or the other end terminal portions.

The raceway, including the central portion and the frusto-conical shaped members are longitudinally slotted in their base sections with the edges of the slot being spaced a distance substantially less than the diameter of the ball, whereby the ball will ride freely on said edges. A ball cage is positioned within the raceway slot, at least within said central portion, whereby the ball cage releasably contacts and guides the ball as the ball moves within the raceway. Contact of the ball with the ball cage causes the ball cage to rotate between either of two positions, and, when so moved, to contact means for actuating a switch associated with the control unit. The ball cage includes a central section for receiving the ball between a pair of points and lateral wings which extend into that end of the raceway not presently occupied by the ball. The wing engaging the ball remains in contact with the ball when the ball is in the enlarged frusto-conical or cylindrical portions at either the distal or proximal ends, and the wings cover the slot therein. The ball is sufficiently large to stay in contact with the wing sections of the ball cage when the ball is disposed in one of the end portions of the housing, however, the ball is small enough to roll freely through the raceway but not through the slot, particularly in the central portion thereof.

It is another object of the present invention to provide means on said ball cage for actuating a magnetic reed switch when said ball cage is rotated.

Other objects will become apparent to those skilled in the art when the drawing is studied in conjunction with the detailed specification.

BRIEF DESCRIPTION OF THE DRAWING

Embodiments of the invention for accomplishing these and other objects are shown in the attached drawing wherein.

DETAILED DESCRIPTION OF THE INVENTION

Figure 1:
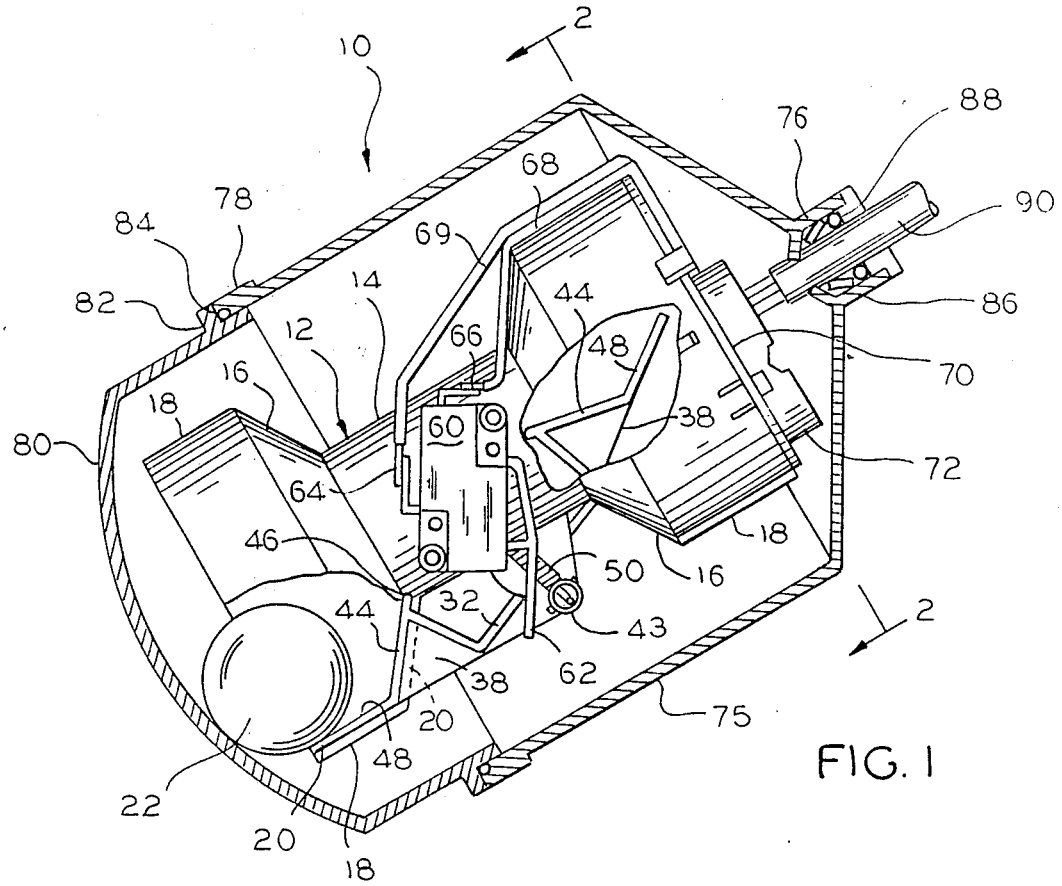
FIG. 1 is a cross sectional view of a float control unit showing a partial section of a ball raceway and switch.
Figure 2:
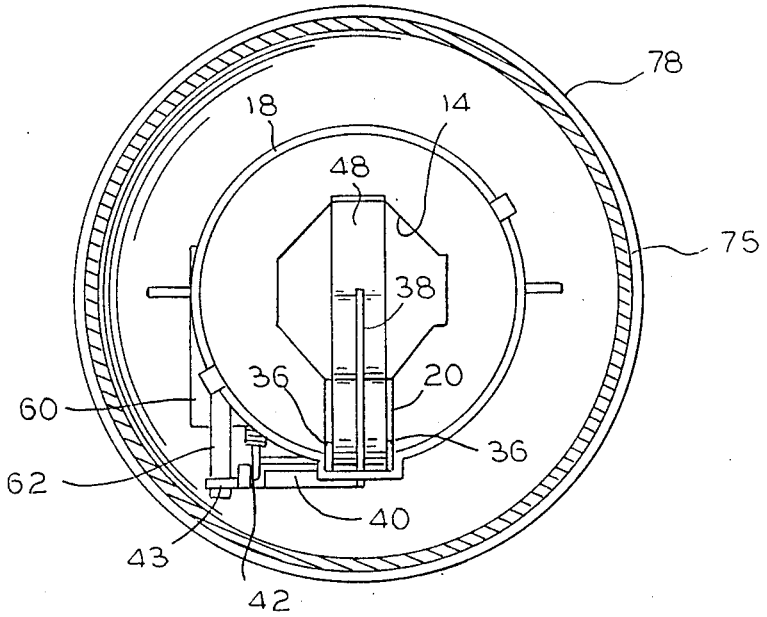
FIG. 2 is an transverse cross sectional view taken along line 2—2 of FIG. 1.
Figure 3:
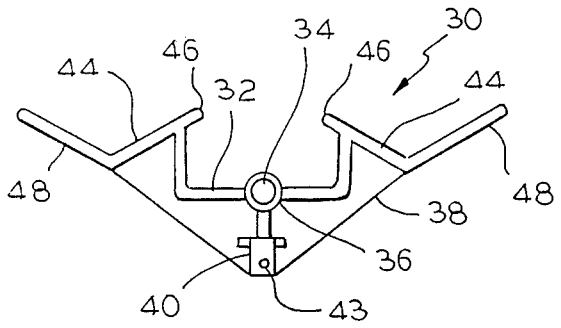
FIG. 3 is a side elevational view of one embodiment of a ball cage contemplated in the present invention.
Figure 4:
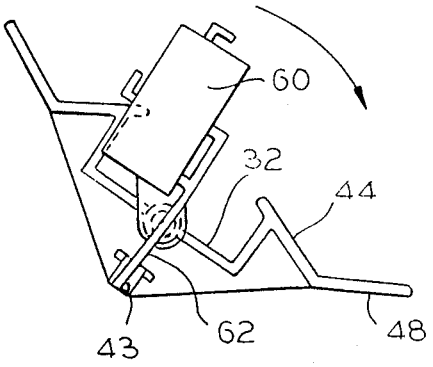
FIG. 4 is another side elevational view of the ball cage shown in FIG. 3 rotated clockwise about a pivot point and showing a switch which the ball cage is acting upon.

Referring now to the drawing, wherein similar parts are referred to by similar numerals, as best seen in FIG. 1, the float control unit, generally designated 10, includes a raceway housing 12 which has a generally hour-glass shape with a restricted central portion 14 that is shown in FIG. 2 as having a hexagonal cross-section, however, it can be cylindrical or any other polygonal or geometric configuration as long as the ball associated herewith is capable of free passage therethrough.

Flaring outwardly from opposite ends of central portion 14 are frusto-conical portions 16 which terminate in cylindrical portions 18. At least the central portion 14 and the frusto-conical portions 16 are slotted, as at 20, on their lower portion, as seen in FIGS. 1 and 2. The opposing edges of slot 20 are spaced apart a predetermined distance less than the diameter of ball 22, whereby the ball 22 can readily roll from end to end of the raceway housing 12 and ride on the edges of slot 20, at least in said central portion 14.

The ball 22 may be made of steel, or any other heavy material, and must be of a diameter to ride freely on opposing edges of slot 20 and move freely through the central portion 14. Other requirements will be set forth hereinafter.

Figure 8:
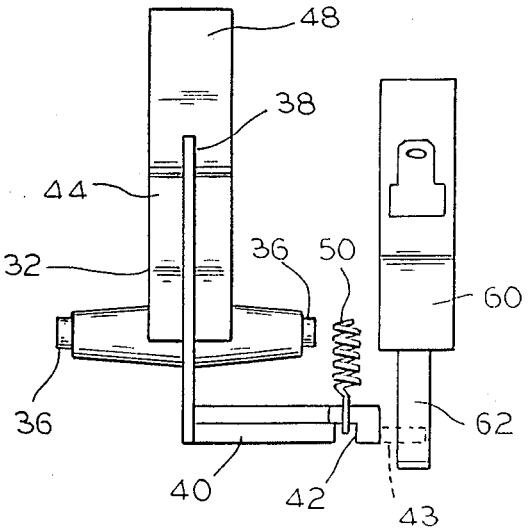
FIG. 8 is an end view of the ball cage in operative engagement with an overcenter spring and a miniature switch.

The ball cage 30 includes a recessed central portion 32 supporting a pivot point 34 with axle 36 and reinforced by a triangular shaped rib 38. A T-shaped member 40 projects laterally from the apex of rib 38. As best seen in FIG. 8, rigid T-shaped member 40 includes notch 42 adjacent its free end, for purposes set forth hereinafter. Extending angularly from central portion 32 are a pair of oppositely depending arms 44 that project inwardly above central recess 32 by means of protuberances 46, while at the opposite end thereof the arms 44 are bent upwardly to form the free arms 48. The side view of ball cage 30 is substantially identical to the cross sectional configuration of one side of the hour-glass shape of the raceway housing 12, with the angled arms 44 conforming to the frusto-conical portions 16 and the free ends of arms 48 complimentary to the cylindrical portions 18.

The axles 36 are captured by appropriate structure depending from the central portion 14, not shown, and the notch 42 in T-shaped member 40 is engaged by an over-center spring which assists in movement of the ball cage 30 from one extreme position to the next and which is further described hereinafter.

As can be best seen in FIGS. 1 and 8, the T-shaped member 40 includes a cylindrical extension 43 which is utilized to activate the switch 60 having an actuating arm 62 and terminals 64 and 66. The terminals 64, 66 are connected by leads 68, 70, for purposes best set forth hereinafter.

Figure 5:
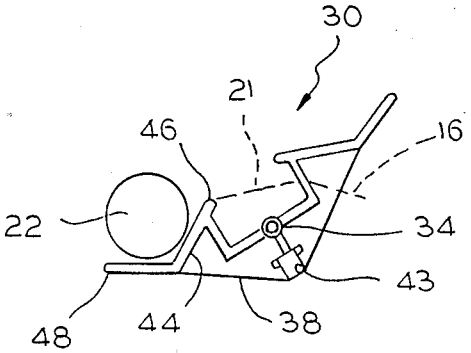
FIGS. 5 through 7 are schematic views of the ball cage in various dispositions about the pivot as a ball moves through the raceway in response to changes in attitude of the float control unit.
Figure 6:
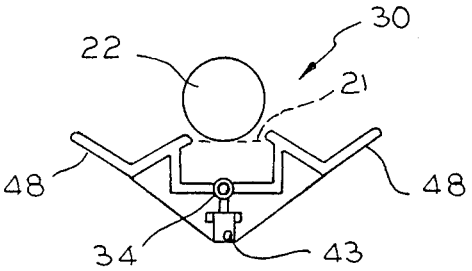
Figure 7:
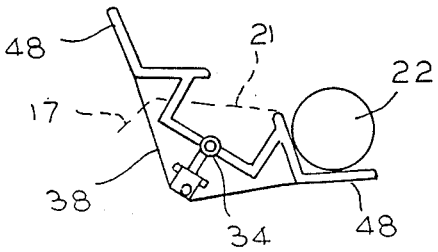
Figure 9:
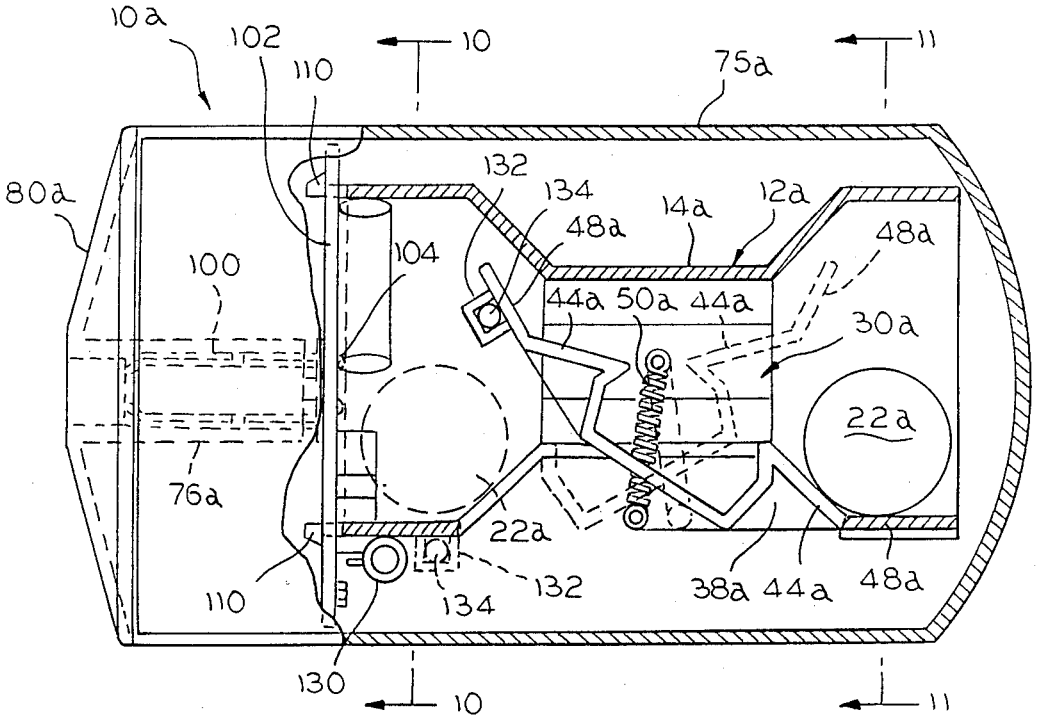
FIG. 9 is a side elevational view in partial section of another embodiment of the float control unit contemplated by the present invention.
Figure 10:
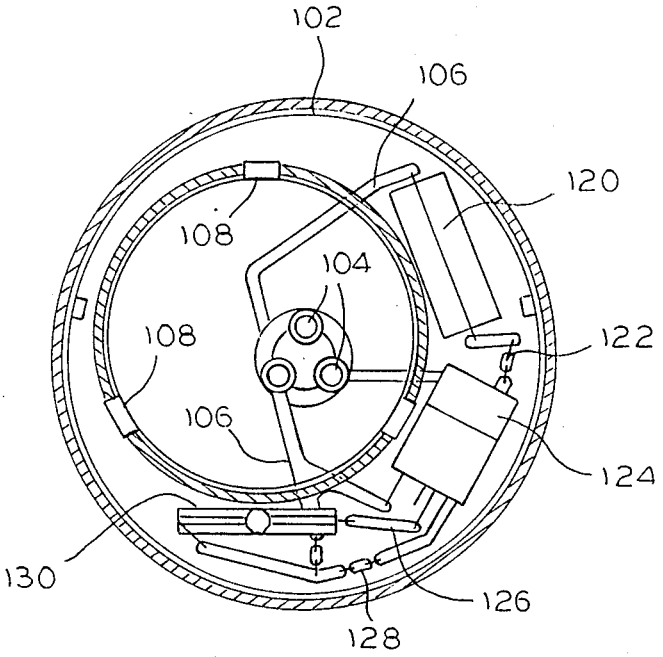
FIG. 10 is a transverse sectional view taken along line 10—10 of FIG. 9.
Figure 11:
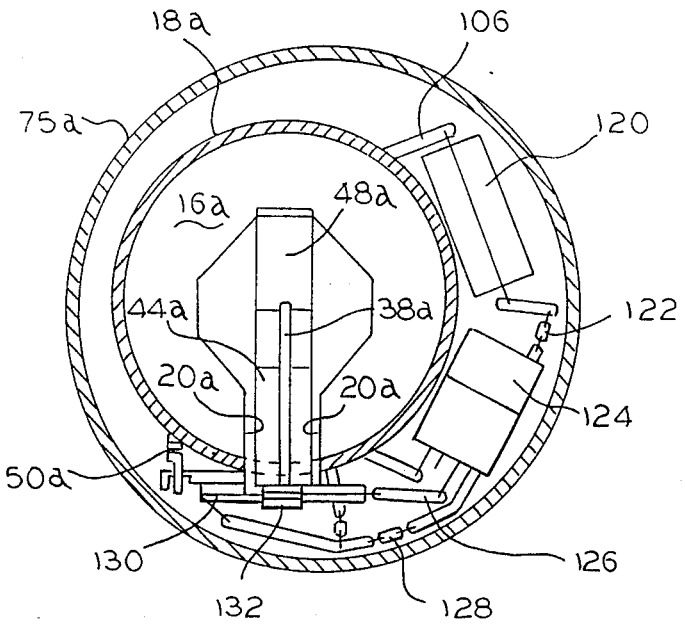
FIG. 11 is a transverse sectional view taken along line 11—11 of FIG. 9 and showing the ball cage rotated to an elevated position as shown in dotted lines in FIG. 9.
Figure 12:
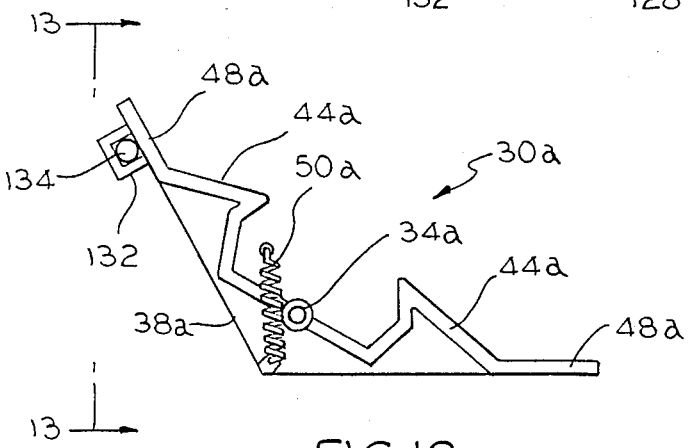
FIG. 12 is an elevation side view of another embodiment of a ball cage carrying a magnet at one end thereof.
Figure 13:
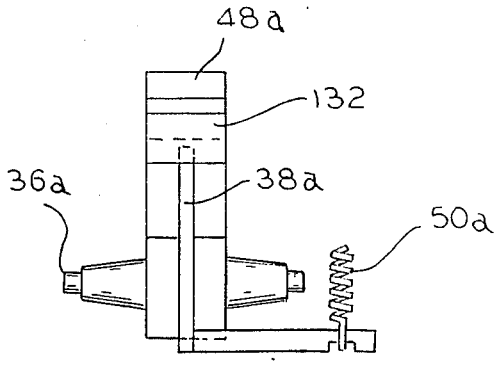
FIG. 13 is an end view of this other embodiment of a ball cage taken along line 13—13 of FIG. 12.

The ball cage 30 is mounted to the housing 12 with the central portion 32 with the arm extensions 46 projecting into the slot 20 in the central restricted portion 14 of said housing 12. As best seen in FIG. 6, when the housing 12 is in a horizontal disposition the edges 21 of the slot 20 (shown herein as dotted line 21) support the ball 22 with the protruberance 46 forming the inwardly protruding inner ends of the arms 44 projecting slightly above the plane of the central portion 14 having slot 20 therein. If the float control unit 10 has its attitude depressed counterclockwise, or downwardly to the left, as seen in FIG. 5, the ball 22 will engage the left protuberance 46 and depress it level with the plane of edges 21 and roll down the arm 44 until the free arm 48 is co-planar with the cylindrical end 18 of the housing 12 (as best seen in FIG. 1). Similarly, if the attitude of the unit 10 is elevated in a clockwise direction the ball will roll in the opposite direction as shown in FIG. 7. In this latter position the extension arm 43 will engage the switch activating arm 62 and close the switch 60 allowing current to flow to the motor, not shown, by the appliance being controlled, and carry out the desired operation.

The entire raceway housing 12 may be provided with an end cap 70 having appropriate means 72 for securing the housing 12 fixedly relative to the outer float housing 75 including an open neck 76 at one end and a reinforcing flange 78 at the opposite end. A cap 80, with complimentary flange means 82 cooperating with flange 78 to retain an O-ring seal 84, hermetically seals the end of float housing 75. The neck 76 includes spring-grip means 86 and sealing means 88 grip and seal the supporting arm 90 that carries the weight of the float control unit 10, as well as permitting the conductors 68, 69 to be extended out through arm 90 to the motor or other equipment being controlled.

In the present invention, the disadvantages of the prior art are overcome. When a ball 22 is present in one of the end portions 18 of the housing 12 it constantly stays in contact with the upper surface of the arm 44 and its extension 48 (as seen in FIG. 1), thereby insuring that it will never be trapped under the arm and cause a malfunction of the switch. Additionally, the overcenter spring 50 retains the cage 30 in one of the extreme positions since it assists the ball in causing the rotation of cage 30 about pivot 34 to a positive position. The ball remains in one of the end portions until the change in attitude of the housing and raceway exceeds an amount determined by the angle between inclined surface 16 of the frusto-conical portion and the longitudinal axis of the central portion 14. Inclined surfaces 16 thereby enable the ball 22 to remain fixed until the attitude of the housing places the ball in a position to roll over apex of the extension 46 of the ball cage and engage the opposite extension 46 to activate the overcenter switch 50 to cause the cage 30 to snap over center and urge the ball to move to the opposite extremity of the housing 14.

A second embodiment of the float control unit 10*a* can be seen in FIGS. 9 through 13, wherein similar numerals will be utilized to identify similar parts with the addition of the suffix "a". In this embodiment the hermetically sealed housing 75*a* includes an end cap 80*a* having inwardly directed neck 76*a* with appropriate contact means 100 included within the neck 76*a*. A rigid printed circuit board 102 is riveted 104 to the end of neck 76*a* with the rivets 104 making contact with contact means 100 and circuit means 106 on the board 102. The board 102 also includes a plurality of circumferentially spaced openings 108 adapted to accept resilient shouldered legs 110 on one end of the raceway housing 12*a*. It will be noted that the housing 12*a* is mounted eccentrically relative to the axis of housing 75*a* to provide additional room for the electronic components 120–128 utilized with a reed switch 130.

In this embodiment one of the differences resides in the mounting of the housing 12*a* by means of the snap legs 110 in the apertures 108 of printed circuit board 102 which is riveted to the neck 76*a* of cap 80*a*. The operation of the ball cage 30*a* is substantially identical to the first embodiment, in that the ball cage 30*a* is pivotably mounted in such a manner to cause the arms 44*a* and 48*a* to extend within slot 20*a*, as was shown in the first embodiment, and contact ball 22*a* as it rides on the edges of slot 20*a*. However, an additional feature in this embodiment the terminal arm 48*a* closest to board 102 includes a retaining cage 132 holding a magnet 134 which when positioned next to reed switch 130, as shown in dotted position of the ballcage 32 in FIG. 1, will actuate the reed switch 130 and induce the flow of current into the appliance being controlled. As a well known fact, the life of reed switches is substantially higher than the life of mechanical switch means. The weight of the magnet 134 is negligible in relation to the mass of the ball 22*a* and hence the operation of the ball cage 30*a* with its overcenter spring 50*a* insures uniform operation of this device.

Other embodiments will be apparent to those skilled in the art and it our intent to be limited only by the appended claims and the equivalents thereto.

I claim:

1. A pivotable float control unit including therewithin a raceway housing pivotable with said float control unit and having a ball with a predetermined diameter movable along a raceway defined by said raceway housing, said ball being complimentarily accepted by said raceway, a ball cage pivotable with respect to said raceway housing and having a plurality of segments, at least one surface of said ball cage exposed within said raceway at any given angular orientation of said pivotable raceway housing, said ball being in contact with said at least one surface of said ball cage during all angular attitudes of said pivoted raceway housing and prevented by said housing and said cage from ever being able to be disposed in contact with a second surface facing oppositely to said one surface of said ball cage said raceway housing having a generally hourglass configuration in longitudinal cross-section, said housing including in co-axial arrangement: a reduced central portion, a pair of outwardly flaring frusto-conical portions individually extending co-axially outwardly from opposite ends of said central portion, and a pair of substantially tubular extensions terminating extending co-axially outwardly from oppositely extending frusto-conical portions and terminating the opposite ends of said housing.

2. A float control unit as claimed in claim 1 wherein said central portion of said raceway housing and at least a substantial portion of said frusto-conical extensions are slotted longitudinally thereof to provide a continuous slot of substantial axial extent beyond the ends of said central portion, said continuous slot being disposed in a position radially below the axis of said raceway housing.

3. A float control unit as claimed in claim 2 wherein said slot includes a pair of oppositely extending substantially parallel spaced edges, said edges being separated a predetermined amount substantially less than the diameter of said ball, whereby said ball will freely roll along on said edge defining said slot.

4. A float control unit as claimed in claim 3 wherein said cage includes a recessed central portion having a generally U-shaped configuration including a base and a pair of upstanding substantially flat arms emanating from opposite ends of said base, a pair of integral downwardly and outwardly extending substantially flat narrow arm means which include inner ends formed by protuberances that project over the mouth of said recessed portion, a pair of upwardly angularly outwardly extending substantially flat narrow arm means each being integral with one of said downwardly and outwardly extending arm means and reinforcing rib means underlying all of said portions to maintain them in substantially rigid configuration.

5. A float control unit as claimed in claim 4 wherein said rib means is generally triangular in configuration and supports the pivot point for said ball cage in the form of laterally extending axle means.

6. A float control unit as claimed in claim 5 wherein said triangular shaped rib means includes a laterally extending rigid arm positioned adjacent the apex of said triangular shaped rib means and adapted to engage an overcenter spring that cooperates with said pivot means for insuring proper pivoting of said cage between opposite pivoted extremes.

7. A float control unit as claimed in claim 6 wherein said rigid arm includes an extension arm that is utilized to actuate switch means.

8. A float control unit as claimed in claim 5 wherein said ball cage is positioned within said slot means and capable of being pivotably moved between either of two stable positions in response to engagement of said ball with said ball cage as said ball moves through said raceway means.

9. A float control unit as claimed in claim 7 wherein said raceway housing, ball, ball cage and switch means are encased in a hermetically sealed housing including means for accepting conductors between the exterior and interior of said sealed housing to register the attitude of said float control unit for controlling appliance means external to said sealed housing.

10. A float control unit as claimed in claim 4 wherein said hermetically sealed housing includes means for supporting the housing in a variety of attitudes to maintain same for operation due to a variation in liquid levels acting upon said housing.

11. A float control unit as claimed in claim 10 wherein said means for supporting said housing is a hollow tubular member sealed to said housing at one end and pivotably supported at a point spaced from said housing.

12. A float control unit as claimed in claim 4 wherein said switch means is mechanical in nature, said cage including an elongate lever arm capable of actuating said switch, whereby movement of said cage by engagement with said ball results in actuation of said switch means.

13. A float control unit as claimed in claim 4 wherein said switch means is a reed switch disposed adjacent one end of said housing, said cage means carrying magnetic means adjacent one end of its terminal arms that is disposed adjacent said one end, whereby movement of said cage means by said ball means results in the actuation of said reed switch means by said magnetic means and activation of the means being controlled by the unit.

* * * * *